US005446009A

United States Patent [19]

Minami et al.

[11] Patent Number: 5,446,009

[45] Date of Patent: Aug. 29, 1995

[54] THERMAL RECORDING SHEET

[75] Inventors: Toshiaki Minami; Tadakazu Fukuchi, both of Tokyo, Japan

[73] Assignee: Nippon Paper Industries Co., Ltd., Tokyo, Japan

[21] Appl. No.: 153,162

[22] Filed: Nov. 17, 1993

[30] Foreign Application Priority Data

Nov. 20, 1992 [JP] Japan ..... 4-310665

[51] Int. Cl.[6] ..... B41M 5/40

[52] U.S. Cl. ..... 503/204; 427/152; 503/207; 503/208; 503/209; 503/210; 503/211; 503/212; 503/216; 503/217; 503/221; 503/226

[58] Field of Search ..... 503/210–212, 503/226, 225, 204, 207–209, 216, 217, 220, 221; 427/152

[56] References Cited

U.S. PATENT DOCUMENTS

| | | | |
|---|---|---|---|
| 4,849,396 | 7/1989 | Satake et al. | 503/210 |
| 4,853,363 | 8/1989 | Satake et al. | 503/210 |
| 4,910,185 | 3/1990 | Satake et al. | 503/210 |

FOREIGN PATENT DOCUMENTS

| | | | |
|---|---|---|---|
| 0286116 | 12/1988 | European Pat. Off. | 503/226 |
| 0405363 | 2/1991 | European Pat. Off. | 503/212 |

*Primary Examiner*—B. Hamilton Hess
*Attorney, Agent, or Firm*—Sherman and Shalloway

[57] ABSTRACT

In a thermal recording sheet including an intermediate layer, and a thermal color developing layer containing a leuco dye type chromogenic component containing a leuco dye and an organic color developer as main ingredients and a metal chelate type chromogenic component containing an electron acceptor and an electron donor as main ingredients, stacked on a substrate, the intermediate layer contains a pigment having an oil absorption of 100 ml/100 g or less measured according to JIS K 5101, and the thermal color developing layer contains at least one of compounds of Formula (I) and Formula (II) as an organic color developer, a metal double salt of higher fatty acid having 16 to 35 carbon atoms as an electron acceptor, and a polyhydric hydroxy aromatic compound of Formula (III) as an electron donor, whereby providing a thermal recording sheet which is superior in dynamic sensitivity, background color, image stability such as oil resistance and plasticizer resistance, and print adaptability:

(I)

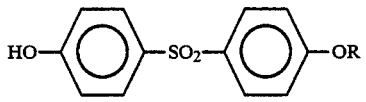

wherein R is propyl, isopropyl, or butyl, (II)

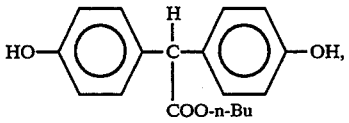

(III)

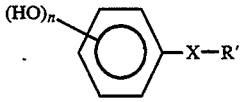

wherein R′ is an alkyl of $C_{18}$ to $C_{35}$,

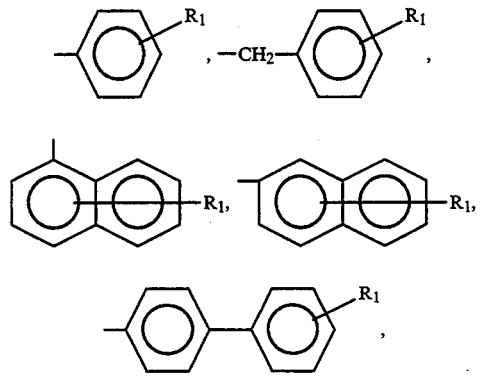

(Abstract continued on next page.)

n is an integer of 2 or 3, X is $—CH_2—$, $—CO_2—$, $—CO—$, $—O—$, $—CONH—$, $—\underset{\underset{R_1}{|}}{CON}—$, $—SO_2—$, $—SO_3$, or $—SO_2NH—$, and $R_1$ is an alkyl of $C_{18}$ to $_{35}$.

22 Claims, No Drawings

THERMAL RECORDING SHEET

FIELD OF THE INVENTION

This invention relates to a thermal recording sheet which is superior in dynamic sensitivity, image storage properties including background color, oil resistance, and plasticizer resistance, and printability.

DESCRIPTION OF THE PRIOR ART

In general, in thermal recording sheets, a normally colorless or pale colored basic chromogenic dye and an organic color developer such as a phenolic substance are individually dispersed into fine particles, mixed, and a binder, a filler, a sensitivity improver, a slip agent, and other additives are added to obtain a coating color, which is coated on a substrate such as paper, synthetic paper, plastic films, and the like. The thermal recording sheet enables color recording by a momentary chemical reaction caused by healing with a thermal pen, a thermal head, a hot stamp, laser light, or the like.

These thermal recording sheets are applied in a variety of areas such as measurement recorders, computer terminal printers, facsimiles, automatic ticket vendors, and bar-code labels, however, with recent diversification and improvement of these recording devices, requirements to the thermal recording sheets have become stricter. For example, with increasing recording speed, it is required to obtain a high-concentration, sharp color image even with a small heat energy and, in addition, to have improved storage stability in terms of light resistance, weather resistance, and oil resistance.

A prior art example of thermal recording sheet is a thermal recording material disclosed, for example, in Japanese Patent Publication 43-1160 or 45-14039, however, this prior art thermal recording material has been low in thermal response, and thus difficult to obtain a sufficient color density by high-speed recording.

Furthermore, since these thermal recording sheets have been considerably inferior in storage stability of recorded image, they have had a problem in that when printed by a bar-code printer, a considerable reduction in image density or blotting when the color image contacts with a plasticizer (DOP, DOA) contained in wrapping films such as polyvinyl chloride films, resulting in a difficulty in reading by a bar-code reader.

To improve the plasticizer resistance, it has been attempted to contain an organic metal salt in the color developing layer containing a leuco dye and an organic chromogenic agent, or provide a protective layer on the color developing layer, but no satisfactory product has been obtained.

In addition to the above thermal color developing system using a leuco dye, there is known a chelate color developing system. For example, Japanese Patent Publication 32-8787 describes a combination of iron stearate (electron acceptor) with tannic acid and gallic acid (electron donor), and Japanese Patent Publication 34-6485 describes a combination of silver stearate, iron stearate, gold stearate, copper stearate, or mercury behenate as an electron acceptor with methyl gallate, ethyl gallate, propyl gallate, butyl gallate, or dodecyl gallate as an electron donor.

However, these thermal recording papers, when used for a thermal recording system by a thermal print head, tend to cause residue or sticking when contacting with the head. Furthermore, they are low in color developing density, have greenish tints, and are thus poor in the background color. In addition, they are unstable to solvents such as alcohols, resulting in flowing out, of the color developing layer.

Japanese Patent Publication Laid-open 59-89193 discloses an example in which a color developing system comprising a leuco dye and a color developer is combined with a color developing system using a metal compound comprising a ferric salt of higher fatty acid and a polyhydric phenol. However, since this example requires a protective layer to hide coloring, it is disadvantageous in cost.

The inventors have described in Japanese Patent Publication Laid-open 62-284782 that a combination of a metal double salt of higher Fatty acid having 16 to 35 carbon atoms with a polyhydric phenol derivative is suitable for high-speed recording, providing a thermal recording sheet with superior storage stability of image to solvents such as alcohols and oil and fats.

However, since the above metal double salt of higher fatty acid itself is slightly skin-colored, when the salt is dispersed and formulated into a coating color, the resulting thermal recording sheet is colored, and thus involves a problem in the image contrast.

Furthermore, thermal recording paper is often printed by offset printing, and is required to have improved printability.

OBJECT OF THE INVENTION

A primary object of the present invention is to provide thermal recording sheet comprising an intermediate layer and a thermal color developing layer containing a leuco dye type chromogenic component and a metal chelate type chromogenic component stacked on a substrate, with improved dynamic sensitivity, image stability in terms of background color, oil resistance, and plasticizer resistance, and printability.

SUMMARY OF THE INVENTION

In accordance with The present invention which solves all of the above problems, there is provided a thermal recording sheet comprising an intermediate layer, and a thermal color developing layer containing a leuco dye type chromogenic component containing a leuco dye and an organic color developer as main ingredients and a metal chelate type chromogenic component containing an electron acceptor and an electron donor as main ingredients, stacked on a substrate, wherein the intermediate layer contains a pigment having an oil absorption of 100 ml/100 g or less measured according to JIS K 5101, and the thermal color developing layer contains at least one of compounds of Formula (I) and Formula (II) as an organic color developer, a metal double salt of higher fatty acid having 16 to 35 carbon atoms as an electron acceptor, and a polyhydric hydroxy aromatic compound of formula (III) as an electron donor.

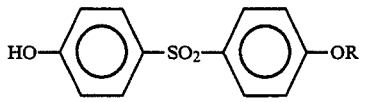

(I)

wherein R is propyl, isopropyl, or butyl,

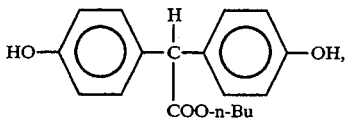

(II)

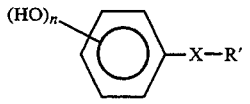

(III)

wherein R′ is an alkyl of $C_{18}$ to $C_{35}$,

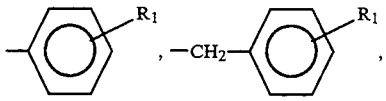

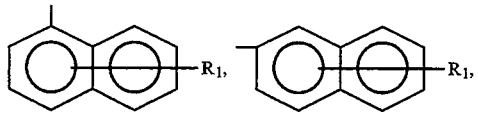

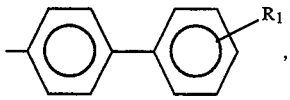

n is an integer of 2 or 3, X is —$CH_2$—, —$CO_2$—, —CO—, —O—, —CONH—,

—CON—, (with $R_1$)

—$SO_2$—, —$SO_3$, or —$SO_2$NH—, and $R_1$ is an alkyl of $C_{18}$ to $_{35}$.

The metal double salt of higher fatty acid used in the present invention means a double salt having at least two types of metal atoms as metal salts of higher fatty acid in the molecule. Being a "double salt," it clearly differs in the physicochemical properties from a so-called "single salt" containing only a single type of metal atom in the molecule which has heretofore been used in a metal chelate type thermal recording sheet.

The metal double salt of higher fatty acid is synthesized by using two or more types of inorganic metal salts when an alkali metal salt or ammonium salt of higher fatty acid and an inorganic metal salt are reacted. Therefore, the types and the mixing ratio of metal atoms in the double salt can be flexibly controlled in the synthesis. For example, by reacting an aqueous solution of sodium behenate with a mixture of aqueous solutions of ferric chloride and zinc chloride in a molar ratio of 2:1, iron zinc behenate containing iron and zinc in a ratio of 2:1.

The metals of the higher fatty acid metal double salt include polyvalent metals or, her than alkali metals such as iron, zinc, calcium, magnesium, aluminum, barium, lead, manganese, tin, nickel, cobalt, copper, silver, and mercury, preferably iron, zinc, calcium, aluminum, magnesium, and silver.

The higher fatty acid metal double salt used in the present invention has a saturated or unsaturated group having 16 to 35 carbon atoms.

Typical higher fatty acid metal salts used in the present invention include, but are not limited to, the following:

1) Iron zinc stearate
2) Iron zinc montanate
3) Acid wax iron zinc
4) Iron zinc behenate
5) Iron calcium behenate
6) Iron aluminum behenate
7) Iron magnesium behenate
8) Silver calcium behenate
9) Tin aluminum behenate
10) Silver magnesium behenate
11) Calcium aluminum behenate These higher fatty acid metal double salts can be used alone or as mixtures thereof as electron acceptors of the thermal recording sheet.

The polyhydric hydroxy aromatic compounds or in other words, polyhydric phenol derivatives, used as electron donors in the present invention include, but are not limited to, the following:

In the below formulas (1) to (23) R and $R_1$ are an alkyl of $C_{18}$ to $C_{35}$.

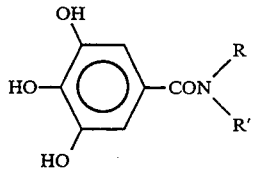

(1)

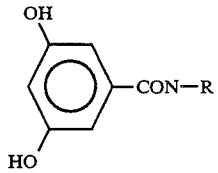

(2)

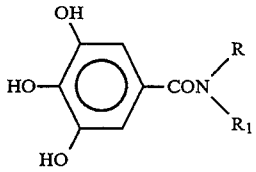

(3)

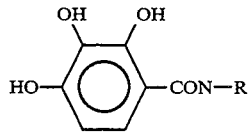

(4)

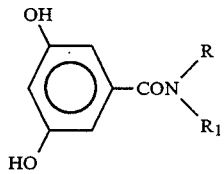

(5)

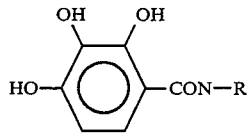

(6)

-continued (7)

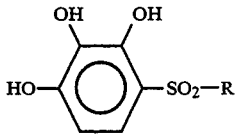

(8)

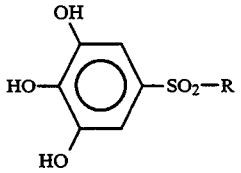

(9)

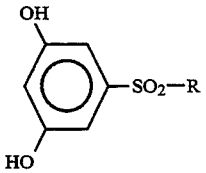

(10)

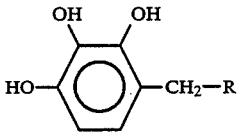

(11)

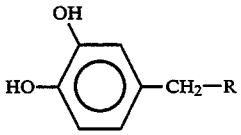

(12)

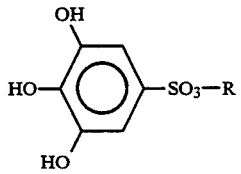

(13)

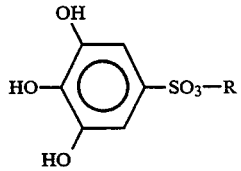

(14)

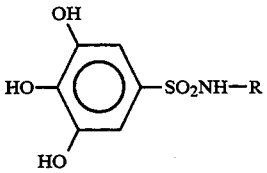

(15)

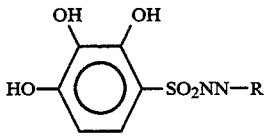

(16)

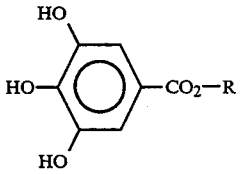

-continued (17)

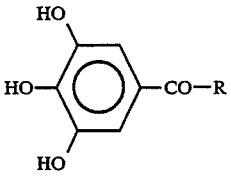

(18)

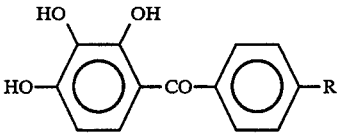

(19)

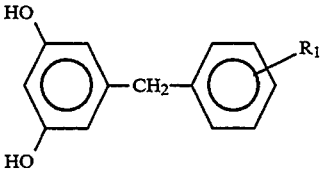

(20)

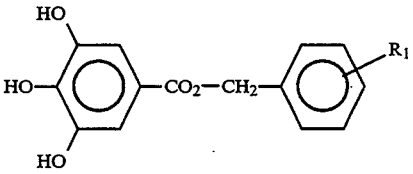

(21)

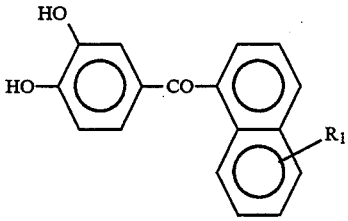

(22)

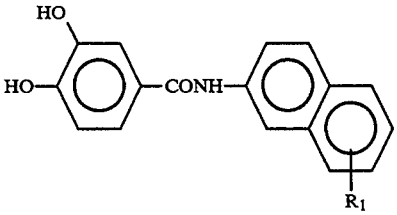

(23)

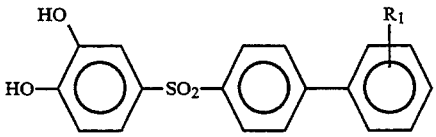

It is necessary to prevent the above polyhydric phenol derivative from reacting with the electron acceptor when the polyhydric phenol derivative is dispersed in an aqueous or solvent-based binder to prepare a coating color, and enhance the solvent resistance and dispersion stability. For this purpose, it is preferable to increase the number of carbon atoms of the substituent other than for the chromogenic groups to 18 to 35. It is also preferable that the number of hydroxyl groups is 2 or 3, adjacent to each other.

These polyhydric phenols can be used alone or, as necessary, as mixtures of two or more.

On the other hand, the organic color developer used in the present invention includes: 4-hydroxy-4'-isopropoxydiphenylsulfone, 4-hydroxy-4'-n-propoxydiphenylsulfone, 4-hydroxy-4'-n-butoxydiphenylsulfone, and bis(4-hydroxyphenyl)acetic acid butyl ester.

The leuco dye used in the present invention is not specifically limited, but is preferably of a fluorane type, of which practical examples are shown below:

Fluorane-type leuco

3-Diethylamino-6-methyl-7-anilinofluorane
3-(N-ethyl-p-toluidino)-6-methyl-7-anilinofluorane
3-(N-ethyl-N-isoamylamino)-6-methyl-7-anilinofluorane
3-Diethylamino-6-methyl-7-(o,p-dimethylanilino)fluorane
3-Pyrrolidino-6-methyl-7-anilinofluorane
3-Piperidino-6-methyl-7-anilinofluorane
3-(N-cyclohexyl-N-methylamino)-6-methyl-7-anilinofluorane
3-Diethylamino-7-(m-trifluoromethylanilino)fluorane
3-N-n-Dibutylamino-6-methyl-7-anilinofluorane
3-N-n-Dibutylamino-7-(o-chloroanilino)fluorane
3-(N-ethyl-N-tetrahdrofurfurylamino)-6-methyl-7-anilinofluorane
3-Dibutylamino-6-methyl-7-(o,p-dimethylanilino)fluorane
3-(N-methyl-N-propylamino)-6-methyl-7-anilinofluorane
3-diethylamino-6-chloro-7-anilinofluorane
3-Dibutylamino-7-(o-chloroanilino)fluorane
3-Diethylamino-7-(o-chloroanilino)fluorane
3-Diethylamino-6-methyl-chlorofluorane
3-Diethylamino-6-methyl-fluorane
e-Cyclohexylamino-6-chlorofluorane
3-Diethylamino-benzo[a]-fluorane
3-n-Dipentylamino-6-methyl-7-anilinofluorane
2-(4-Oxo-hexyl)-3-dimethylamino-6-methyl-7-anilinofluorane
2-(4-Oxo-hexyl)-3-diethylamino-6-methyl-7-anilinofluorane
2-(4-Oxo-hexyl)-3-dipropylamino-6-methyl-7-anilinofluorane These dyes can be used alone or as mixtures of two or more.

In the present invention, the pigment to be used in the intermediate layer is an inorganic or organic pigment having an oil absorption (according to JIS K 5101) of 100 ml/100 g or less. Such a pigment includes inorganic pigments such as alumina, magnesium hydroxide, calcium hydroxide, magnesium carbonate, zinc oxide, barium sulfate, silica, calcium carbonate, kaolin, calcined kaolin, diatomaceous earth, talc, titanium oxide, and aluminum hydroxide, and organic pigments such as urea-formaldehyde resin, styrene-methacrylic acid copolymer, polystyrene resin, and amino resin fillers. Furthermore, inorganic and organic pigments based on conventional pigments which are physically and chemically processed to lave the above specific oil absorption can also be appropriately employed. Of these pigments, since calcined kaolin is particularly superior in heat insulation and has a high improvement effect to recording sensitivity, it can be advantageously employed. In this case, when the oil absorption is greater than 100 ml/100 g, the binder component in the intermediate layer and the thermal recording layer tends to be penetrating and absorbed during coating of the intermediate layer on the substrate and subsequent coating of the thermal recording layer, resulting in a considerable reduction in printing strength.

The ratio of the pigment used in the intermediate layer is not specifically limited, but is typically 60 to 95% by weight, preferably 70 to 90% by weight, to the total solid. The coating coverage is not specifically limited, but is contained typically in an amount of 2 to 20 g/m$^2$, preferably in an amount of 4 to 10 g/m$^2$.

An image stabilizer may be contained in the present invention, such as 4,4'-butylidene(6-t-butyl-3-methylphenol), 2,2'-di-t-butyl-5,5'-dimethyl-4-,4'-sulfonyldiphenol, 1,1,3-tris(2-methyl-4-hydroxy-5-cyclohexylphenyl)butane,1,1,3-tris(2-methyl-4-hydroxy-5-t-butylphenyl)butane, 4-benzyloxy-4'-(2,3-epoxy-2-methylpropoxy)diphenylsulfone, bisphenol A type epoxy resin, or novolac type epoxy resin.

Furthermore, as a sensitizer, fatty acid amides such as stearamide, palmitamide, or the like; ethylene-bisamide, montan wax, polyethylene wax, dibenzyl terephthalate, benzyl p-benzyloxybenzoate, di-p-tolylcarbonate, p-benzylbiphenyl, phenyl-$\alpha$-naphthylcarbonate, 1,4-diethoxynaphthalene, phenyl-1-hydroxy-2-naphthoate, 1,2-di-(3-methylphenoxy) ethane, di(p-methylbenzyl-)oxalate, $\beta$-benzyloxynaphthalene, 4-biphenyl-p-tolylether, o-xylylene-bis-(phenylether), 4-(m-methylphenoxymethyl)biphenyl, or the like can be added.

In the present invention, the binder used in the intermediate and the thermal recording layer can be completely-hydrolyzed polyvinylalcohol with a polymerization degree of 200 to 1,900, partially-hydrolyzed polyvinylalcohol, carboxy-modified polyvinylalcohol, amide-modified polyvinylalcohol, sulfonic acid-modified polyvinylalcohol, butyral-modified polyvinylalcohol, and other modified polyvinylalcohols, hydroxyethylcellulose, methylcellulose, carboxymethylcellulose, styrene-maleic anhydride copolymer, styrene-butadiene copolymer, styrene-acrylate copolymer, acrylonitrile-butadiene copolymer; cellulose derivatives such as ethylcellulose and acetylcellulose; polyvinylchloride, polyvinylacetate, polyacrylamide, polyacrylic esters, polyvinylbutyral, polystyrene and their copolymers, polyamide resins, silicone resins, petroleum resins, terpene resins, ketone resins, coumarone resins, starch, starch derivatives, and casein. These polymeric substances are used in the state emulsified in water or other solvents, or can be used in combination according to the property requirements.

In addition to the above, it is possible to use releasing agents such as fatty acid metal salts, slip agents such as waxes, benzophenone- or triazole-based ultraviolet absorbers, water resistant agents such as glyoxal, dispersants, defoamers, and the like.

The amounts of the organic color developer, the leuco dye, the electron acceptor and donor and the types and amounts of other constituents used in the thermal color developing layer of the present invention are determined according to the required properties and recording adaptability. Typically, 1 to 8 parts of the organic color developer, 1 to 8 parts of the electron acceptor, 1 to 8 parts of the electron donor, and 1 to 20 parts of the fillers are used based on 1 part of the leuco dye, and it is appropriate to use the binder in an amount of 10 to 25% of the total solid.

The coating color of the above composition can be coated on any type of substrate such as paper, synthetic paper, plastic films, non-woven fabrics, or the like to obtain the objective thermal recording sheet.

Furthermore, the sheet can be provided on the thermal color developing layer with an overcoating layer comprising a polymeric substance containing a pigment, or on the substrate with a back coating layer comprising a polymeric substance, to improve the storage stability.

The organic color developer, the leuco dye, the electron acceptor, the electron donor, and the materials which are added as needed are dispersed by a dispersing machine such as a ball mill, an attriter, a sand grinder, or the like, or by an appropriate emulsifying apparatus to a particle diameter of several microns or less, and mixed with the binder and various additives according to the purpose to obtain a coating color.

In the thermal recording sheet of the present invention, the formation method of the intermediate layer and the recording layer is not specifically limited, but these layers can be formed by a conventional method known in the art, and off-machine coaters or on-machine coaters provided with an air knife coater, a rod blade coater, a bill blade coater, a roll coater, or the like can be appropriately selected.

Furthermore, after the intermediate layer and the recording layer are coated and dried, the individual layer can be smoothed as needed by a super-calender or the like.

In the present invention, the reason why the effect of the present invention is obtained by providing the specific intermediate layer and the specific thermal color developing layer on the substrate is considered as follows:

In the present invention, the intermediate layer mainly comprising a specific pigment having an oil absorption of 100 ml/100 g is provided between the substrate and the thermal color developing layer. With this arrangement, the intermediate layer fills and smooths microscopic irregularities on the surface of the base paper to suppress penetration of the thermal recording layer coating color, thereby obtaining a heat insulating layer having a high void ratio and enabling uniform coating of the thermal recording layer with a high surface strength. Thus, the dynamic sensitivity and the printability are improved.

Furthermore, the reason why the thermal recording sheet of the present invention is superior in the background color and the coloring properties of the surface is that the thermal recording sheet is high in opacity because of the above stack structure and due to the combination of the specific organic color developer with a reduced water solubility with the chelate type color developing component.

Furthermore, the reason why the color developed image is superior in oil resistance and plasticizer resistance is that the leuco type color developing component and the chelate type color developing component are simultaneously contained in the thermal color developing layer, and the polyhydric hydroxy aromatic compound as the electron donor reacts with the specific organic color developer and the leuco dye to form stable color developed image.

DESCRIPTION OF PREFERRED EMBODIMENTS

The present invention will now be described with reference to the examples. In the description, part means part by weight.

EXAMPLE 1 (Test Nos. 1–4)

| Formation of the intermediate layer | Part |
|---|---|
| Calcined kaolin (tradename: ANSILEX, ENGEL | 100 |

-continued

| Formation of the intermediate layer | Part |
|---|---|
| HARD, oil absorption: 90 ml/100 g) | |
| Styrene-butadiene copolymer latex (solid content: 48%) | 11 |
| 10% Aqueous polyvinylalcohol solution | 5 |

The above compositions were blended to obtain a coating color for the intermediate layer. The coating color was coated on fine paper with a substance of 50 g/m$^2$ to a dry coating amount of 6 g/m$^2$ and dried.

| (Formation of the thermal color developing layer) | Part |
|---|---|
| Solution A (color developer dispersion) | |
| Color developer (Table 1) | 3.0 |
| 10% Aqueous polyvinylalcohol solution | 9.4 |
| Water | 5.6 |
| Solution B (dye dispersion) | |
| 3-N-n-dibutylamino-6-methyl-7-anilinofluorane | 2.0 |
| 10% aqueous polyvinylalcohol solution | 4.6 |
| Water | 2.6 |
| Solution C (electron acceptor dispersion) | |
| Electron acceptor (Table 1) | 3.0 |
| 10% aqueous polyvinylalcohol solution | 10.0 |
| Water | 6.0 |
| Solution D (electron donor dispersion) | |
| Electron donor (Table 1) | 3.0 |
| 10% Aqueous polyvinylalcohol solution | 10.0 |
| Water | 6.0 |

The above dispersions were individually ground by a sand grinder to an average particle diameter of 0.4 to 1 micron. Then, the dispersions were mixed in the following ratio to obtain a coating color.

| | |
|---|---|
| Solution A | 18.0 parts |
| Solution B | 9.2 |
| Solution C | 19.0 |
| Solution D | 19.0 |
| Calcium carbonate (50% dispersion) | 12.0 |

The above thermal color developing layer coating color was coated on top of the intermediate layer obtained above to a dry coating amount of 5.0 g/m$^2$ and dried. The resulting sheet was super-calendered to a smoothness of 700–800 seconds to obtain a thermal recording sheet.

EXAMPLE 2 (Test Nos. 5–8)

| Formation of the intermediate layer | Part |
|---|---|
| Calcined kaolin (tradename: DELTATEX, ECC, oil absorption: 70 ml/100 g) | 100 |
| Styrene-butadiene copolymer latex (solid content: 48%) | 11 |
| 10% Aqueous polyvinylalcohol solution | 5 |

The above compositions were blended to obtain a coating color for the intermediate layer. The coating color was coated on fine paper with a substance of 50 g/m$^2$ to a dry coating amount of 6 g/m$^2$ and dried. Furthermore, the thermal color developing layer coating color as used in Example 1 was coated on top of the intermediate layer obtained above to a dry coating amount of 5.0 g/m$^2$ and dried. The resulting sheet was super-calendered to a smoothness of 700–800 seconds to obtain a thermal recording sheet.

EXAMPLE 3 (Test Nos. 9–12)

| Formation of the intermediate layer | Part |
|---|---|
| Calcined kaolin (tradename: HUBER 80C, HUBER, oil absorption: 60 ml/100 g) | 100 |
| Styrene-butadiene copolymer latex (solid content: 48%) | 11 |
| 10% Aqueous polyvinylalcohol solution | 5 |

The above compositions were blended to obtain a coating color for the intermediate layer. The coating color was coated on fine paper with a substance of 50 g/m$^2$ to a dry coating amount of 6 g/m$^2$ and dried. Furthermore, the thermal color developing layer coating color as used in Example 1 was coated on top of the intermediate layer obtained above to a dry coating amount of 5.0 g/m$^2$ and dried. The resulting sheet was super-calendered to a smoothness of 700–800 seconds to obtain a thermal recording sheet.

EXAMPLE 4 (Test Nos. 13–16)

| Formation of the intermediate layer | Part |
|---|---|
| Calcined kaolin (tradename: XC1300F, ECC, oil absorption: 70 ml/100 g) | 50 |
| Styrene-based polymeric fine particles having cross-linking structure (tradename: GLOSSDERU 201S, Mitsui Toatsu), oil absorption: 70 ml/100 g) | 50 |
| Styrene-butadiene copolymer latex (solid content: 48%) | 11 |
| 10% Aqueous polyvinylalcohol solution | 5 |

The above compositions were blended to obtain a coating color for the intermediate layer. The coating color was coated on fine paper with a substance of 50 g/m$^2$ to a dry coating amount of 6 g/m$^2$ and dried. Furthermore, the thermal color developing layer coating color as used in Example 1 was coated on top of the intermediate layer obtained above to a dry coating amount of 9.0 g/m$^2$ and dried. The resulting sheet was super-calendered to a smoothness of 700–800 seconds to obtain a thermal recording sheet.

COMPARATIVE EXAMPLE 1 (Test Nos. 7–20)

| Formation of the intermediate layer | Part |
|---|---|
| Silicon dioxide (tradename: NIPSIL E-743, NIPPON SILICA, oil absorption: 165 ml/100 g) | 100 |
| Styrene-butadiene copolymer latex (solid content: 48%) | 11 |
| 10% Aqueous polyvinylalcohol solution | 5 |

The above compositions were blended to obtain an intermediate layer coating color. The coating color was coated on fine paper with a substance of 50 g/m$^2$ to a dry coating amount of 6 g/m$^2$ and dried.

| (Formation of the thermal color developing layer) | Part |
|---|---|
| Solution A (color developer dispersion) | |
| Color developer (Table 2) | 3.0 |
| 10% Aqueous polyvinylalcohol solution | 9.4 |
| Water | 5.6 |
| Solution B (dye dispersion) | |
| 3-N-n-dibutylamino-6-methyl-7-anilinofluorane | 2.0 |
| 10% aqueous polyvinylalcohol solution | 4.6 |

-continued

| (Formation of the thermal color developing layer) | Part |
|---|---|
| Water | 2.6 |
| Solution C (electron acceptor dispersion) | |
| Electron acceptor (Table 2) | 3.0 |
| 10% aqueous polyvinylalcohol solution | 10.0 |
| Water | 6.0 |
| Solution D (electron donor dispersion) | |
| Electron donor (Table 2) | 3.0 |
| 10% aqueous polyvinylalcohol solution | 10.0 |
| Water | 6.0 |

The above dispersions were individually ground by a sand grinder to an average particle diameter of 0.4 to 1 micron. Then, the dispersions were mixed in the following ratio to obtain a coating color.

| | |
|---|---|
| Solution A | 18.0 parts |
| Solution B | 9.2 |
| Solution C | 19.0 |
| Solution D | 19.0 |
| Calcium carbonate (50% dispersion) | 12.0 |

The above thermal color developing layer coating color was coated on top of the intermediate layer obtained above to a dry coating amount of 5.0 g/m$^2$ and dried. The resulting sheet was super-calendered to a smoothness of 700–800 seconds to obtain a thermal recording sheet.

COMPARATIVE EXAMPLE 2 (Test Nos. 21–22)

| (Formation of the intermediate layer) | Part |
|---|---|
| Silicon dioxide (tradename: NIPSIL E-743, NIPPON SILICA, oil absorption: 165 ml/100 g) | 100 |
| Styrene-butadiene copolymer latex (solid content: 48%) | 11 |
| 10% Aqueous polyvinylalcohol solution | 5 |

The above compositions were blended to obtain an intermediate layer coating color. The coating color was coated on fine paper with a substance of 50 g/m$^2$ to a dry coating amount of 6 g/m$^2$ and dried.

| (Formation of the thermal color developing layer) | Part |
|---|---|
| Solution A (color developer dispersion) | |
| Color developer (Table 2) | 3.0 |
| 10% Aqueous polyvinylalcohol solution | 9.4 |
| Water | 5.6 |
| Solution B (dye dispersion) | |
| 3-N-n-dibuitylamino-6-inethyl-7-anilinofluorane | 2.0 |
| 10% aqueous polyvinylalcohol solution | 4.6 |
| Water | 2.6 |
| Solution C (electron acceptor dispersion) | |
| Electron acceptor (Table 2) | 3.0 |
| 10% aqueous polyvinylalcohol solution | 10.0 |
| Water | 6.0 |
| Solution D (electron donor dispersion) | |
| Electron donor (Table 2) | 3.0 |
| 10% aqueous polyvinylalcohol solution | 10.0 |
| Water | 6.0 |

The above dispersions were individually ground by a sand grinder to an average particle diameter of 0.4 to 1 micron. Then, the dispersions were mixed in the following ratio to obtain a coating color.

| | |
|---|---|
| Solution A | 18.0 parts |
| Solution B | 9.2 |
| Solution C | 19.0 |
| Solution D | 19.0 |
| Calcium carbonate (50% dispersion) | 12.0 |

The above thermal color developing layer coating color was coated on top of the intermediate layer obtained above to a dry coating amount of 5.0 g/m$^2$ and dried. The resulting sheet was super-calendered to a smoothness of 700–800 seconds to obtain a thermal recording sheet.

COMPARATIVE EXAMPLE 3 (Test Nos. 23–24)

| Formation of the thermal color developing layer | Part |
|---|---|
| Solution E (color developer dispersion) | |
| Color developer (Table 2) | 3.0 |
| 10% Aqueous polyvinylalcohol solution | 9.4 |
| Water | 5.6 |
| Solution B (dye dispersion) | |
| 3-N-n-dilbutylamino-6-methyl-7-anilinofluorane | 2.0 |
| 10% aqueous polyvinylalcohol solution | 4.6 |
| Water | 2.6 |
| Solution C (electron acceptor dispersion) | |
| Electron acceptor (Table 2) | 3.0 |
| 10% aqueous polyvinylalcohol solution | 10.0 |
| Water | 6.0 |

-continued

| Formation of the thermal color developing layer | Part |
|---|---|
| Solution D (electron donor dispersion) | |
| Electron donor (Table 2) | 3.0 |
| 10% aqueous polyvinylalcohol solution | 10.0 |
| Water | 6.0 |

The above dispersions were individually ground by a sand grinder to an average particle diameter of 0.4 to 1 micron. Then, the dispersions were mixed in the following ratio to obtain a coating color.

| | |
|---|---|
| Solution E | 18.0 parts |
| Solution B | 9.2 |
| Solution C | 19.0 |
| Solution D | 19.0 |
| Calcium carbonate (50% dispersion) | 12.0 |

The above thermal color developing layer coating color was coated on top of the intermediate layer obtained above to a dry coating amount of 5.0 g/m$^2$ and dried. The resulting sheet was super-calendered to a smoothness of 700–800 seconds to obtain a thermal recording sheet.

The thermal recording sheets obtained in the above Examples and Comparative Examples were tested for the properties. The test results are summarized in Table 1 and Table 2.

TABLE 1

Test Results

| Test No. | Electron acceptor | Electron donor | Organic color developer |
|---|---|---|---|
| Example 1 | | | |
| 1 | Ag,Mg stearate* (2:1) | 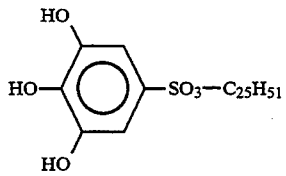 | 4-Hydroxy-4'-n-propoxydiphenyl-sulfone |
| 2 | Fe,Mg behenate (2:1) | 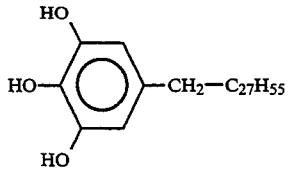 | Same as above |
| 3 | Fe,Al behenate (2:1) | 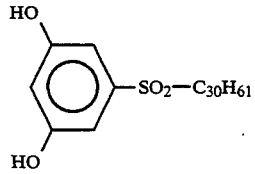 | Same as above |
| 4 | Fe,Al stearate (2:1) | 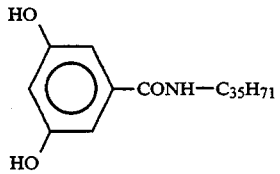 | 4-Hydroxy-4'-n-butoxydiphenylsulfone |
| Example 2 | | | |

TABLE 1-continued

Test Results

| | | | |
|---|---|---|---|
| 5 | Fe,Ca stearate (2:1) | 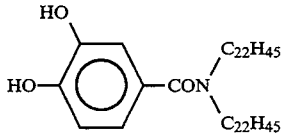 | Same as above |
| 6 | Fe,Zn behenate (2:1) | 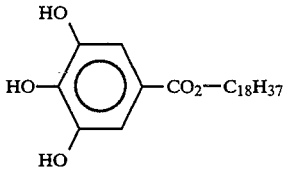 | 4-Hydroxy-4'-isopropoxydiphenyl-sulfone |
| 7 | Fe,Ca behenate (2:1) | 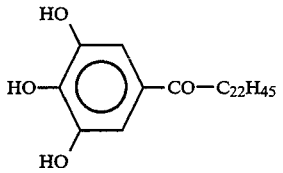 | Same as above |
| 8 | Ag,Al stearate (2:1) | 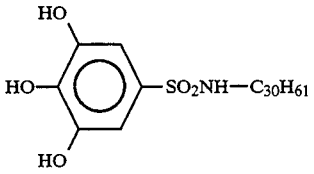 | Same as above |

Example 3

| | | | |
|---|---|---|---|
| 9 | Ag,Mg stearate (2:1) | 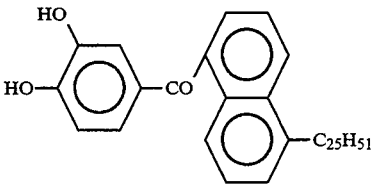 | Same as above |
| 10 | Fe,Mg behenate (2:1) | 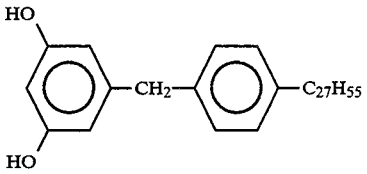 | Bis(4-hydroxy-phenyl)acetic acid butyl ester |
| 11 | Fe,Al behenate (2:1) | 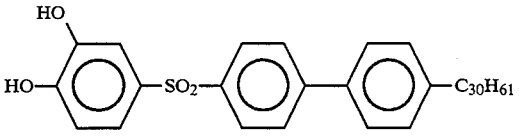 | Same as above |
| 12 | Fe,Al stearate (2:1) | 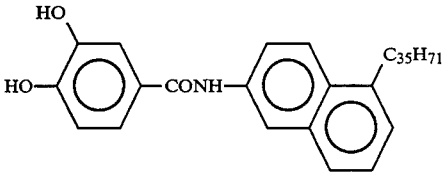 | Same as above |

| Test No. | Color density (1) | Back-ground color (2) | Surface coloring (3) | Oil resistance resistance (4) | | | Plasticizer resistance (5) | | | Print adaptability (6) |
|---|---|---|---|---|---|---|---|---|---|---|
| | | | | Un-treated | Oil-treated | Reten-tion | Un-treated | Oil-treated | Reten-tion | |
| Example 1 | | | | | | | | | | |
| 1 | 1.21 | 0.04 | Good | 1.21 | 1.09 | 90 | 1.21 | 1.10 | 91 | Good |
| 2 | 1.24 | 0.04 | Good | 1.24 | 1.13 | 91 | 1.24 | 1.17 | 94 | Good |
| 3 | 1.23 | 0.04 | Good | 1.23 | 1.13 | 92 | 1.23 | 1.12 | 91 | Good |

TABLE 1-continued

| | | | | | | | | | | |
|---|---|---|---|---|---|---|---|---|---|---|
| | | | | Test Results | | | | | | |
| 4 | 1.25 | 0.04 | Good | 1.25 | 1.16 | 93 | 1.25 | 1.16 | 93 | Good |
| Example 2 | | | | | | | | | | |
| 5 | 1.25 | 0.04 | Good | 1.25 | 1.15 | 92 | 1.25 | 1.16 | 93 | Good |
| 6 | 1.23 | 0.04 | Good | 1.23 | 1.14 | 93 | 1.23 | 1.13 | 93 | Good |
| 7 | 1.24 | 0.04 | Good | 1.24 | 1.13 | 91 | 1.24 | 1.13 | 91 | Good |
| 8 | 1.22 | 0.04 | Good | 1.22 | 1.15 | 94 | 1.22 | 1.10 | 90 | Good |
| Example 3 | | | | | | | | | | |
| 9 | 1.20 | 0.04 | Good | 1.20 | 1.10 | 92 | 1.20 | 1.12 | 93 | Good |
| 10 | 1.21 | 0.04 | Good | 1.21 | 1.09 | 90 | 1.21 | 1.09 | 90 | Good |
| 11 | 1.22 | 0.04 | Good | 1.22 | 1.15 | 94 | 1.22 | 1.11 | 91 | Good |
| 12 | 1.21 | 0.04 | Good | 1.21 | 1.09 | 90 | 1.21 | 1.13 | 93 | Good |

TABLE 2

| | | | |
|---|---|---|---|
| | | Test Results | |
| Test No. | Electron acceptor | Electron donor | Organic color developer |
| Example 4 | | | |
| 13 | Fe,Zn behenate (2:1) | 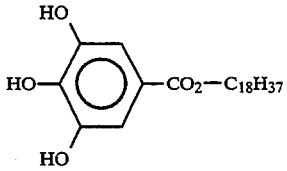 | 4-Hydroxy-4'-isopropoxydiphenyl-sulfone |
| 14 | Fe,Ca behenate (2:1) | 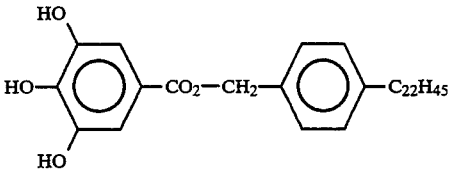 | Same as above |
| 15 | Ag,Al stearate (2:1) | 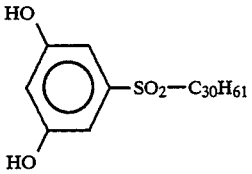 | Same as above |
| 16 | Fe,Ca stearate (2:1) | 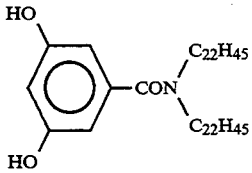 | Same as above |
| Comparative Example 1 | | | |
| 17 | Fe,Ca stearate (2:1) | 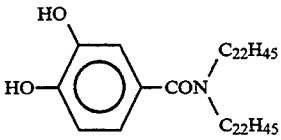 | 4-Hydroxy-4'-isopropoxydiphenyl-sulfone |
| 18 | Fe,Zn behenate (2:1) | 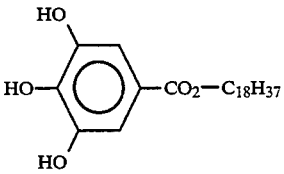 | Same as above |

TABLE 2-continued

Test Results

| | | | |
|---|---|---|---|
| 19 | Fe,Ca behenate (2:1) | 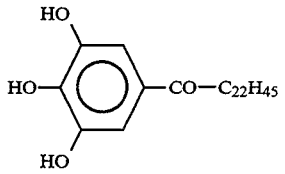 | Same as above |
| 20 | Ag,Al stearate (2:1) | 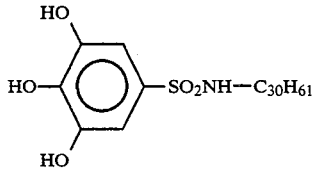 | Same as above |
| Comparative Example 2 | | | |
| 21 | Fe,Ca stearate (2:1) | 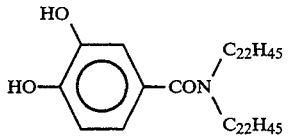 | 4,4'-Cyclohexyl-idenediphenol |
| 22 | Fe,Zn behenate (2:1) | 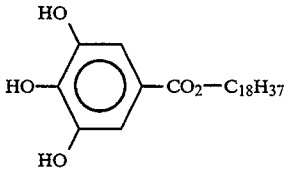 | 4,4'-Sulfonyl-diphenol |
| Comparative Example 3 | | | |
| 23 | Fe,Ca behenate (2:1) | 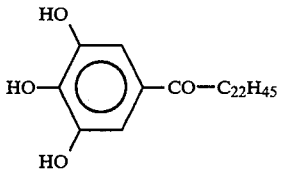 | p-tert-Butylphenol |
| 24 | Ag,Al stearate (2:1) | 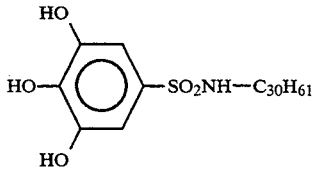 | Monobenzyl phthalate |

| Test No. | Color density (1) | Back-ground color (2) | Surface coloring (3) | Oil resistance resistance (4) Un-treated | Oil-treated | Reten-tion | Plasticizer resistance (5) Un-treated | Oil-treated | Reten-tion | Print adaptability (6) |
|---|---|---|---|---|---|---|---|---|---|---|
| Example 4 | | | | | | | | | | |
| 13 | 1.22 | 0.04 | Good | 1.22 | 1.15 | 94 | 1.22 | 1.10 | 90 | Good |
| 14 | 1.25 | 0.04 | Good | 1.25 | 1.15 | 92 | 1.25 | 1.18 | 93 | Good |
| 15 | 1.24 | 0.04 | Good | 1.24 | 1.13 | 91 | 1.24 | 1.13 | 91 | Good |
| 16 | 1.23 | 0.04 | Good | 1.23 | 1.14 | 93 | 1.23 | 1.16 | 92 | Good |
| Comparative Example 1 | | | | | | | | | | |
| 17 | 1.20 | 0.05 | Fair | 1.20 | 1.06 | 88 | 1.20 | 1.02 | 85 | Poor |
| 18 | 1.19 | 0.05 | Fair | 1.19 | 1.06 | 89 | 1.19 | 0.94 | 79 | Poor |
| 19 | 1.21 | 0.05 | Fair | 1.21 | 1.03 | 85 | 1.21 | 0.99 | 82 | Poor |
| 20 | 1.22 | 0.05 | Fair | 1.22 | 1.05 | 86 | 1.22 | 0.98 | 80 | Poor |
| Comparative Example 2 | | | | | | | | | | |
| 21 | 1.19 | 0.17 | Poor | 1.19 | 0.98 | 81 | 1.19 | 0.98 | 82 | Poor |
| 22 | 1.18 | 0.21 | Poor | 1.18 | 0.97 | 82 | 1.18 | 0.96 | 81 | Poor |
| Comparative Example 3 | | | | | | | | | | |
| 23 | 0.95 | 0.15 | Poor | 0.95 | 0.73 | 77 | 0.95 | 0.72 | 76 | Fair |
| 24 | 0.93 | 0.20 | Poor | 0.93 | 0.74 | 80 | 0.93 | 0.73 | 79 | Fair |

Note (1) Dynamic color developing density: Image density recorded using the Matsushita Denso Thermal Note (2) Background color: White paper portion is measured by the Macbeth densitometer.

Note (3): Surface coloring: Degree of surface coloring is visually observed, and evaluated as almost no coloring (Good); slight coloring (Fair); and much coloring (Poor).

Note (4) Oil resistance: Image density of the sample dynamically printed by the method (1) is measured by the Macbeth densitometer, and the measurement result is defined as untreated density. Salad oil is dropped onto the printed portion and, after 3 days, wiped out lightly with filter paper and the density is measured by the Macbeth densitometer. Retention is calculated by the following equation:

$$\text{Retention} = \frac{\text{Image density after treatment}}{\text{Untreated image density}} \times 100\ (\%) \qquad \text{Formula 1}$$

Note (5) Plasticizer resistance: Image density of the sample dynamically printed by the method (1) is measured by the Macbeth densitometer, and the measurement result is defined as untreated density. Polyvinylchloride films (Mitsui Toatsu HI-WRAP KHA) are overlapped on the surface and backside of the printed sample, and allowed to stand in a 40° C. constant temperature tester for 24 hours. The image density is measured by the Macbeth densitometer. Retention is calculated by the following equation:

$$\text{Retention} = \frac{\text{Image density after treatment}}{\text{Untreated image density}} \times 100\ (\%) \qquad \text{Formula 2}$$

Note (6) Print adaptability: Using TOYO INK WEB KING GS-R (carbon), the sample is tested for print adaptability (ink adherence, printed surface strength) by a rotary inking tester (RI Tester).

The effects of the present invention are as follows:

(1) With superior heat response, a sharp, high-density image can be obtained even in high-speed, high-density recording.

(2) Superior in background color and surface coloring properties.

(3) Almost no discoloration occurs when contacting with a plasticizer, salad oil, or vinegar.

(4) Superior in print adaptability in UV printing and non-UV printing.

What is claimed is:

1. A thermal recording sheet comprising an intermediate layer, and a thermal color developing layer containing a leuco dye chromogenic component containing a leuco dye and an organic color developer as main ingredients and a metal chelate chromogenic component containing an electron acceptor and an electron donor as main ingredients, stacked on a substrate, wherein said intermediate layer contains a pigment having an oil absorption of 100 ml/100 g or less measured according to JIS K 5101, and said thermal color developing layer contains at least one of compounds of Formula (I) and Formula (II) as an organic color developer, a metal double salt of higher fatty acid having 16 to 35 carbon atoms as an electron acceptor, and a polyhydric hydroxy aromatic compound of Formula (III) as an electron donor, said Formulas I, II and III compounds being represented by the following

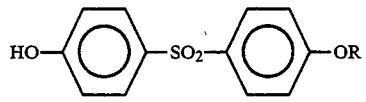

(I)

wherein R is propyl, isopropyl, or butyl,

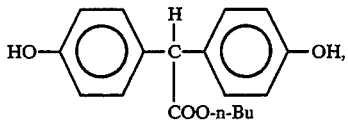

(II)

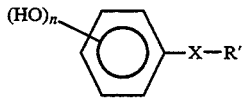

(III)

wherein R' is an alkyl of $C_{18}$ to $C_{35}$,

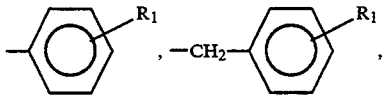

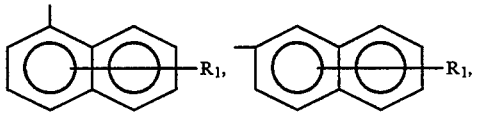

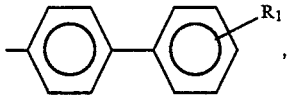

n is an integer of 2 or 3, X is —$CH_2$—, —$CO_2$—, —CO—, —O—, —CONH—,

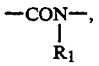

—$SO_2$—, —$SO_3$, or —$SO_2NH$—, and $R^1$ is san alkyl of $C_{18}$ to $C_{35}$.

2. The thermal recording sheet of claim 1 wherein said leuco dye is a fluorane leuco dye.

3. The thermal recording sheet of claim 1 wherein said pigment having an oil absorption of 100 ml/100 g or less measured according to JIS K 5101 is an inorganic pigment.

4. The thermal recording sheet of claim 1 wherein said pigment having an oil absorption of 100 ml/100 g or less measured according to JIS K 5101 is calcined kaolin.

5. The thermal recording sheet of claim 1 wherein said intermediate layer contains said pigment in an amount of 60 to 95% by weight based on the total solid of said intermediate layer.

6. The thermal recording sheet of claim 1 wherein said intermediate layer contains said pigment in an amount of 70 to 90% by weight based on the total solid of said intermediate layer.

7. The thermal recording sheet of claim 1 wherein said intermediate layer is coated in an amount of 2 to 20 $g/m^2$.

8. The thermal recording seet of claim 1 wherein said intermediate layer is coated in an amount of 4 to 10 g/m$^2$.

9. The thermal recording sheet of claim 1 wherein said thermal color developing layer contains at least one image stabilizer selected from the group consisting of 4,4'-butylidene(6-t-butyl-3-methylphenol), 2,2'-di-t-butyl-dimethyl-4,4'-sulfonyldiphenol, 1,1,3-tris(2-methyl-4-hydroxy-5-cyclohexylphenyl)butane, 1,1,3-tris(2-methyl-4-hydroxy-5-t-butylphenyl)butane, 4-benzyloxy-4'-(2,3-epoxy-2-methylpropoxy)diphenylsulfone, bisphenol A epoxy resin, and novolac epoxy resin.

10. The thermal recording sheet of claim 1 wherein said thermal color developing layer contains at least one sensitizer selected from the group consisting of stearamide, palmitamide, ethylene-bisamide, montan wax, polyethylene wax, dibenzyl terephthalate, benzyl p-benzyloxybenzoate, di-p-tolylcarbonate, p-benzylbiphenyl, phenyl-α-naphthylcarbonate, 1,4-diethoxynaphthalene, phenyl-1-hydroxy-2-naphthoate, 1,2-di-(3-methylphenoxy) ethane, di(p-methylbenzyl)oxalate, β-benzyloxynaphthalene, 4-biphenyl-p-tolylether, o-xylylene-bis-(phenylether), and 4-(m-methylphenoxymethyl)biphenyl.

11. A thermal recording sheet comprising an intermediate layer, and a thermal color developing layer containing a leuco dye chromogenic component containing a leuco dye and an organic color developer as main ingredients and a metal chelate chromogenic component containing an electron acceptor and an electron donor as main ingredients, stacked on a substrate, wherein said intermediate layer contains an inorganic pigment having an oil absorption of 100 ml/100 g or less measured according to JIS K 5101 in an amount of 60 to 95% by weight based on the total solid of said intermediate layer, and said intermediate layer is coated in an amount of 2 to 20 g/m$^2$, and said thermal color developing layer contains at least one of compounds of Formula (I) and Formula (II) as an organic color developer, a metal double salt of higher fatty acid having 16 to 35 carbon atoms as an electron acceptor, and a polyhydric hydroxy aromatic compound of Formula (III) as an electron donor, said Formula I, II and III compounds being represented by the following:

(I)

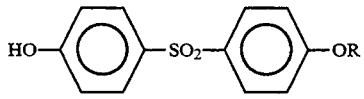

wherein R is propyl, isopropyl, or butyl, (II)

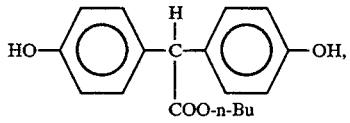

(III)

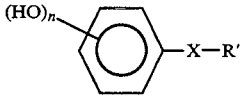

wherein $R^1$ is an alkyl of $C_{18}$ to $C_{35}$,

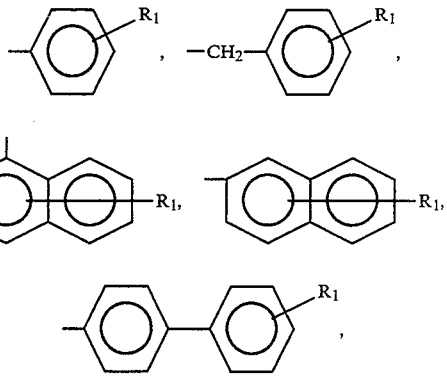

n is an integer of 2 or 3, X is —$CH_2$—, —$CO_2$—, —CO—, —O—, —CONH—,

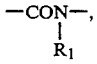

—$SO_2$—, —$SO_3$, or —$SO_2$NH—, and $R_1$ is an alkyl of $C_{18}$ to $_{35}$.

12. The thermal recording sheet of claim 11 wherein said leuco dye is a fluorane leuco dye.

13. The thermal recording sheet of claim 11 wherein said pigment having an oil absorption of 100 ml/100 g or less measured according to JIS K 5101 is calcined kaolin.

14. The thermal recording sheet of claim 11 wherein said intermediate layer contains said pigment in an amount of 70 to 90% by weight based on the total solid of said intermediate layer.

15. The thermal recording sheet of claim 11 wherein said intermediate layer is coated in an amount of 4 to 10 g/m$^2$.

16. The thermal recording sheet of claim 11 wherein said thermal color developing layer contains at least one image stabilizer selected from the group consisting of 4,4'-butylidene(6-t-butyl-3-methylphenol), 2,2'-di-t-butyl-dimethyl-4,4'-sulfonyldiphenol, 1,1,3-tris(2-methyl-4-hydroxy-5-cyclohexylphenyl)butane, 1,1,3-tris(2-methyl-4-hydroxy-5-t-butylphenyl)butane, 4-benzyloxy-4'-(2,3-epoxy-2-methylpropoxy)diphenylsulfone, bisphenol A epoxy resin, and novolac epoxy resin.

17. The thermal recording sheet of claim 11 or 16, wherein said thermal color developing layer contains at least one sensitizer selected from the group consisting of stearamide, palmitamide, ethylene-bisamide, montan wax, polyethylene wax, dibenzyl terephthalate, benzyl p-benzyloxybenzoate, di-p-tolylcarbonate, p-benzylbiphenyl, phenyl-α-naphthylcarbonate, 1,4-diethoxynaphthalene, phenyl-1-hydroxy-2-naphthoate, 1,2-di-(3-methylphenoxy) ethane, di(p-methylbenzyl)oxalate, β-benzyloxynaphthalene, 4-biphenyl-p-tolylether, o-xylylene-bis-(phenylether), and 4-(m-methylphenoxymethyl)biphenyl.

18. A thermal recording sheet comprising an intermediate layer, and a thermal color developing layer containing a fluorane leuco dye chromogenic component containing a leuco dye and an organic color developer as main ingredients, and a metal chelate chromogenic component containing an electron acceptor and an electron donor as main ingredients, stacked on a substrate, wherein said intermediate layer contains an inorganic calcined koalin pigment having an oil absorption of 100 ml/100 g or less measured according to JIS K 5101, in an amount of 60 to 95% by weight based on the total solid of said intermediate layer, and said intermediate layer is coated in an amount of 2 to 20 g/m$^2$, and said thermal color developing layer contains at least one of compounds of Formula (I) and Formula (II) as an organic color developer, a metal double salt of higher fatty acid having 16 to 35 carbon atoms as an electron acceptor, and a polyhydric hydroxy aromatic compound of Formula (III) as an electron donor, said Formula I, II and III compounds being represented by the following:

(I)

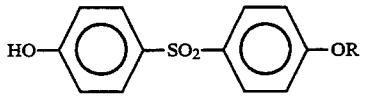

wherein R is propyl, isopropyl, or butyl, (II)

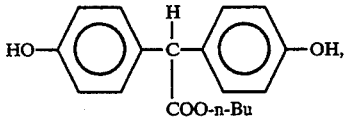

(III)

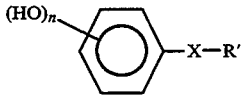

wherein R′ is an alkyl of $C_{18}$ to $C_{35}$,

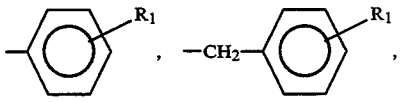

-continued

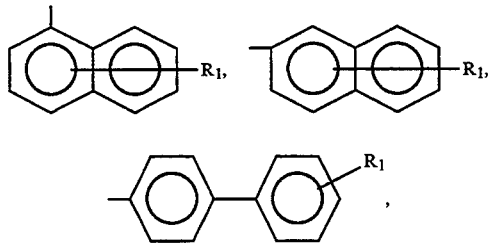

n is an integer of 2 or 3, X is —$CH_2$—, —$CO_2$—, —CO—, —O—, —CONH—,

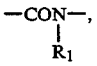

—$SO_2$—, —$SO_3$, or —$SO_2NH$—, and $R_1$ is an alkyl of $C_{18}$ to $_{35}$.

19. The thermal recording sheet of claim 18, wherein said intermediate layer contains said pigment in an amount of 70 to 90% by weight based on the total solid of said intermediate layer.

20. The thermal recording sheet of claim 18, wherein said intermediate layer is coated in an amount of 4 to 10 g/m$^2$.

21. The thermal recording sheet of claim 18, wherein said thermal color developing layer contains at least one image stabilizer selected from the group consisting of 4,4′-butylidene(6-t-butyl-3-methylphenol), 2,2′-di-t-butyl-dimethyl-4,4′-sulfonyldiphenol, 1,1,3-tris(2-methyl-4-hydroxy-5-cyclohexylphenyl)butane, 1,1,3-tris(2-methyl-4 -hydroxy-5-t-butylphenyl)butane, 4-benzyloxy-4′-(2,3-epoxy-2-methylpropoxy)diphenylsulfone, bisphenol A epoxy resin, and novolac epoxy resin.

22. The thermal recording sheet of claim 18 or 21, wherein said thermal color developing layer contains at least one sensitizer selected from the group consisting of stearamide, palmitamide, ethylene-bisamide, montan wax, polyethylene wax, dibenzyl terephthalate, benzyl p-benzyloxybenzoate, di-p-tolylcarbonate, p-benzylbiphenyl, phenyl-α-naphthylcarbonate, 1,4-diethoxynaphthalene, phenyl-1-hydroxy-2-naphthoate, 1,2-di-(3-methylphenoxy) ethane, di(p-methylbenzyl)oxalate, β-benzyloxynaphthalene, 4-biphenyl-p-tolylether, o-xylylene-bis-(phenylether), and 4-(m-methylphenoxymethyl)biphenyl.

* * * * *